US009856123B1

(12) United States Patent
Mantz

(10) Patent No.: US 9,856,123 B1
(45) Date of Patent: Jan. 2, 2018

(54) SPOUT FOR DRAINING LIQUID FROM A CONTAINER

(71) Applicant: Nicholas A. Mantz, Rubicon, WI (US)

(72) Inventor: Nicholas A. Mantz, Rubicon, WI (US)

( * ) Notice: Subject to any disclaimer, the term of this patent is extended or adjusted under 35 U.S.C. 154(b) by 0 days.

(21) Appl. No.: 15/275,870

(22) Filed: Sep. 26, 2016

(51) Int. Cl.
*B67D 1/00* (2006.01)
*B67B 7/86* (2006.01)
*B65D 1/16* (2006.01)
*B65D 17/00* (2006.01)

(52) U.S. Cl.
CPC ..... *B67B 7/28* (2013.01); *B65D 1/165* (2013.01); *B65D 17/02* (2013.01)

(58) Field of Classification Search
CPC .... B67B 7/28; B67B 7/24; B67B 7/26; B56D 17/02; B65D 1/165
USPC ..... 222/86, 83, 83.5, 81, 82, 85, 89, 90; 220/277, 278
See application file for complete search history.

(56) References Cited

U.S. PATENT DOCUMENTS 1,072,588 A * 9/1913 Ducan ..... B65D 25/2811 222/470
1,354,110 A * 9/1920 Kitaoka ..... B67B 7/26 222/548
1,366,858 A * 1/1921 Anderson ..... B67B 7/28 222/484
1,380,662 A * 6/1921 Rand ..... B67B 7/28 222/475
1,824,318 A * 9/1931 Smith ..... B67B 7/26 220/278
2,070,930 A 2/1937 Squires
2,138,318 A * 11/1938 Willis ..... B67B 7/28 222/473
2,304,457 A * 12/1942 Hagan ..... B67B 7/28 222/484
2,501,653 A * 3/1950 Keating ..... B67B 7/28 220/278
2,544,095 A * 3/1951 Kower ..... B67B 7/28 222/500
3,637,113 A * 1/1972 Stehl ..... B67B 7/28 222/86

* cited by examiner

*Primary Examiner* — Lien Ngo
(74) *Attorney, Agent, or Firm* — Donald J. Ersler

(57) ABSTRACT

A spout for draining liquid from a container preferably includes a puncture member and a handle member. The puncture member includes a retainer base, an air puncture tube and a liquid puncture tube. An end of the air and liquid puncture tubes are cut at an angle to create cutting tips. The handle member includes a clip base, a top support extension, a bottom support extension, a top clip and a bottom clip. Through openings are formed through the top and bottom support extensions, and the clip base to receive the air and liquid puncture tubes. In use, the top clip is inserted into a top rim of a beverage can and the bottom clip is snapped into a bottom cavity of the beverage can. The clip base is squeezed toward the retainer base with one hand to create two puncture openings in the beverage can.

16 Claims, 4 Drawing Sheets

SPOUT FOR DRAINING LIQUID FROM A CONTAINER

BACKGROUND OF THE INVENTION

1. Field of the Invention

The present invention relates generally to liquid containers and more specifically to a spout for draining liquid from a container, which allows a beverage can to be quickly drained.

2. Discussion of the Prior Art

U.S. Pat. No. 2,070,930 to Squires discloses a device for withdrawing liquid from metal containers.

Accordingly, there is a clearly felt need in the art for a spout for draining liquid from a container, which allows a beverage can to be quickly drained.

SUMMARY OF THE INVENTION

The present invention provides a spout for draining liquid from a container, which allows a beverage can to be quickly drained. The spout for draining liquid from a container (drain spout) preferably includes a puncture member and a handle member. The puncture member includes a retainer base, an air puncture tube and a liquid puncture tube. A proximal end of the air puncture tube extends from one end of the retainer base and a proximal end of the liquid puncture tube extends from an opposing end of the retainer base. A distal end of the air puncture tube is cut at an angle to create an air cutting tip. An inner perimeter of the air puncture tube does not extend through the retainer base. At least one cross hole is formed through a proximal end of the inner perimeter of the air puncture tube to exhaust air. A distal end of the liquid puncture tube is cut at angle to create a liquid cutting tip. An inner perimeter of the liquid puncture tube extends through the retainer base. The air puncture tube and the liquid puncture tube are substantially parallel to each other.

The handle member includes a clip base, a top support extension, a bottom support extension, a top clip and a bottom clip. The top support extension extends from one end of the clip base. An air through opening is formed through the top support extension and the clip base to slidably receive the air puncture tube. The bottom support extension extends from an opposing end of the clip base. A liquid through opening is formed through the bottom support extension and the clip base to slidably receive the liquid puncture tube. The top clip extends upward from a top of the top support extension. The top clip includes an inverted U-shape. The bottom clip extends downward from a bottom of bottom support extension. The bottom clip includes a U-shape. In use, the top clip is inserted into a top rim of a beverage can and the bottom clip is snapped into a bottom cavity of the beverage can. The air puncture tube and liquid puncture tube of the puncture member are inserted into the air and liquid openings of the handle member. The proximal end of the liquid puncture tube is positioned for flow of liquid from the beverage can. The clip base is squeezed toward the retainer base with one hand, which results in a liquid puncture opening in a bottom of the beverage can and an air puncture opening in a top of the beverage can. The contents of the can will flow out through the liquid puncture tube.

Accordingly, it is an object of the present invention to provide a drain spout, which allows a beverage can to be quickly drained.

These and additional objects, advantages, features and benefits of the present invention will become apparent from the following specification.

DETAILED DESCRIPTION OF THE PREFERRED EMBODIMENTS

Figure 3:
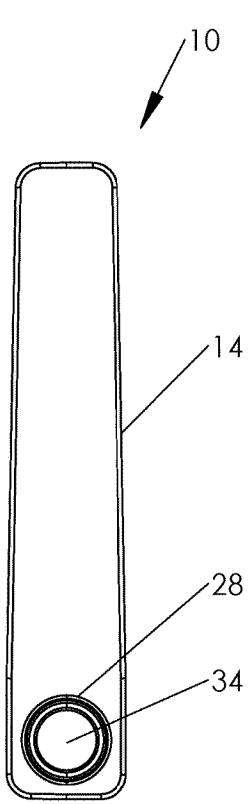
FIG. 3 is a front view of a puncture member of a drain spout in accordance with the present invention.
Figure 2:
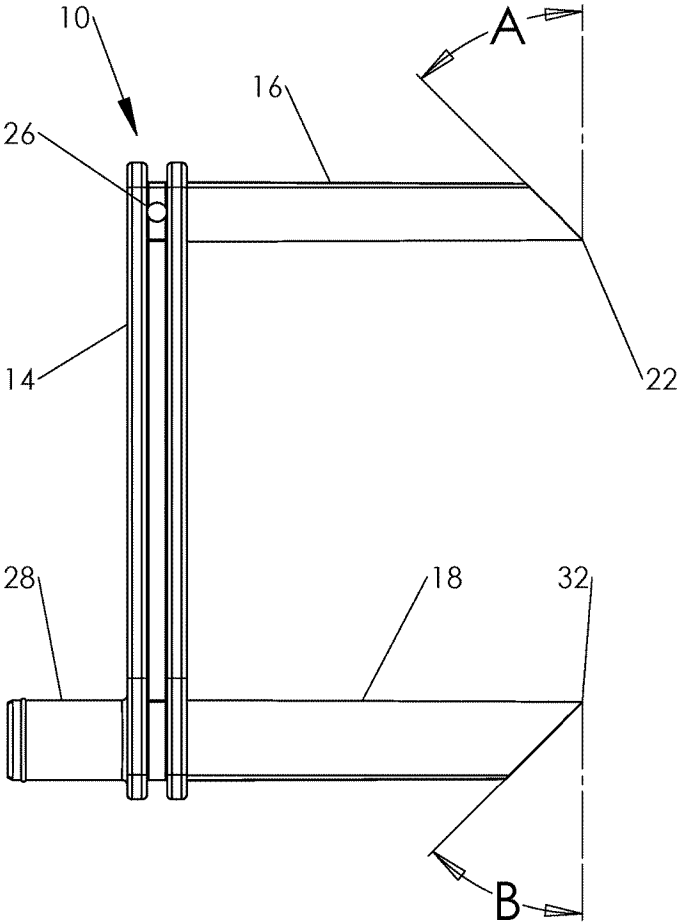
FIG. 2 is a side view of a puncture member of a drain spout in accordance with the present invention.
Figure 1:
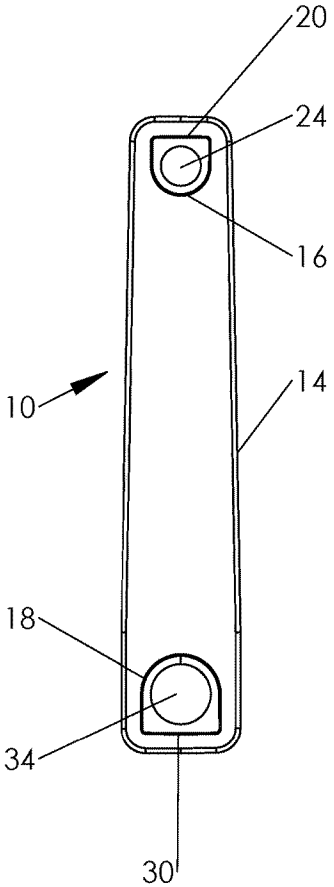
FIG. 1 is a rear view of a puncture member of a drain spout in accordance with the present invention.
Figure 6:
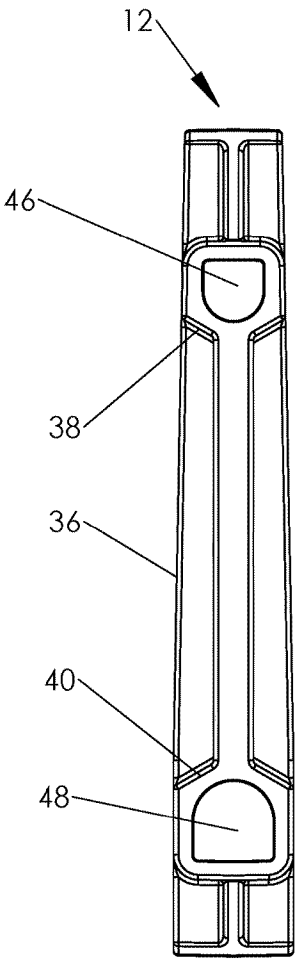
FIG. 6 is a front view of a handle member of a drain spout in accordance with the present invention.
Figure 5:
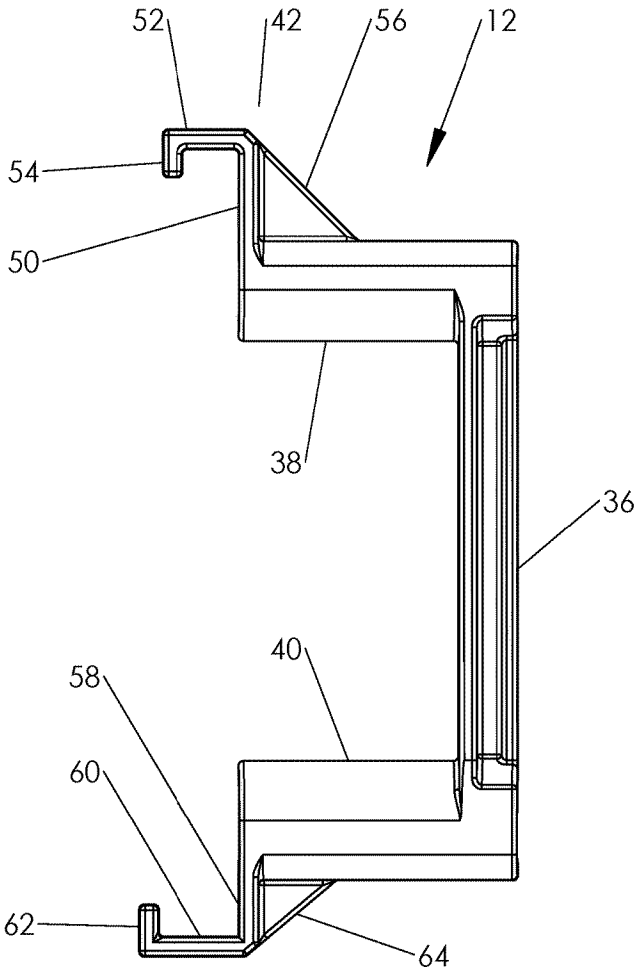
FIG. 5 is a side view of a handle member of a drain spout in accordance with the present invention.
Figure 4:
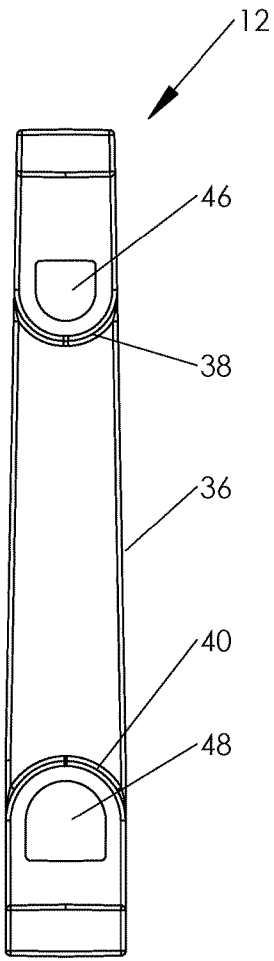
FIG. 4 is a rear view of a handle member of a drain spout in accordance with the present invention.
Figure 8:
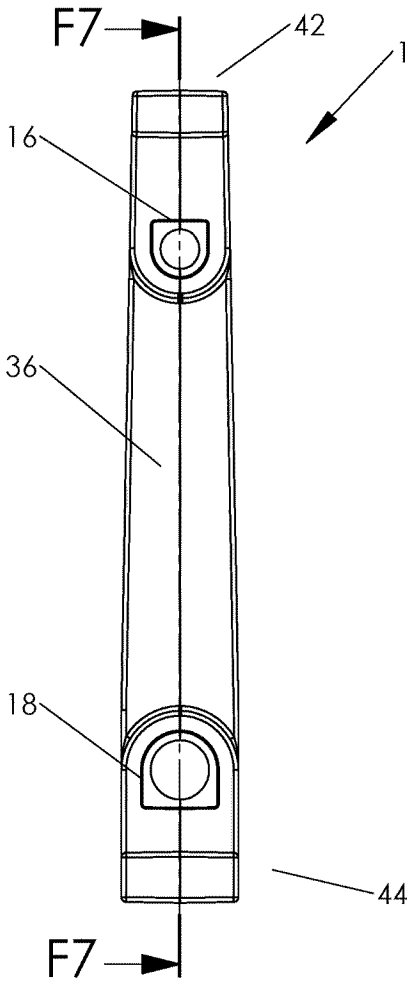
FIG. 8 is a rear view of a drain spout in accordance with the present invention.
Figure 7:
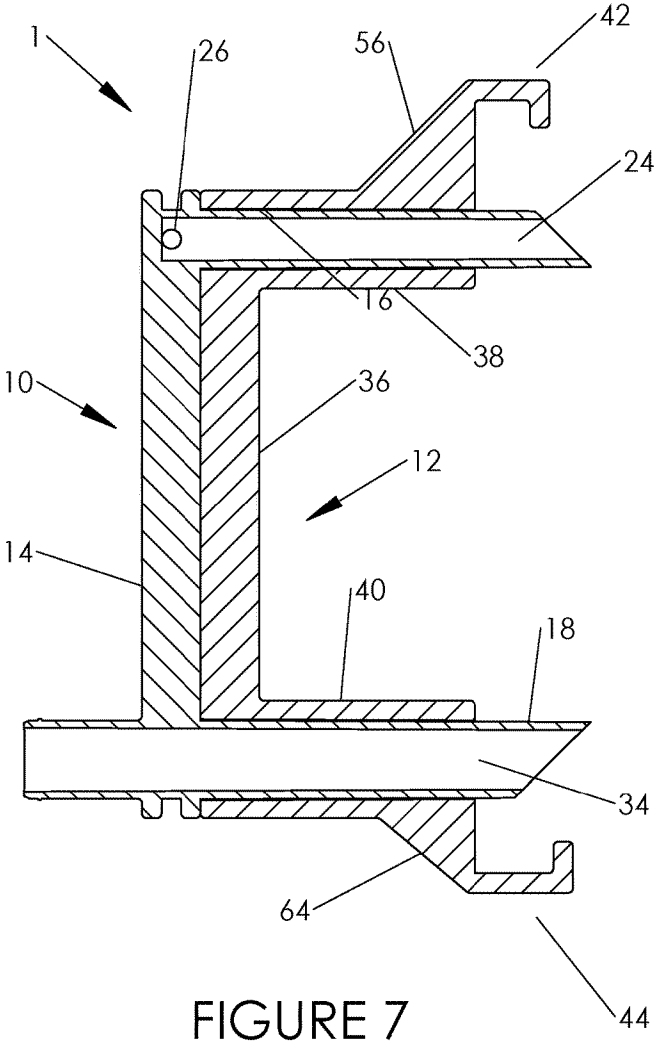
FIG. 7 is a cross sectional side view of a drain spout in accordance with the present invention.
Figure 9:
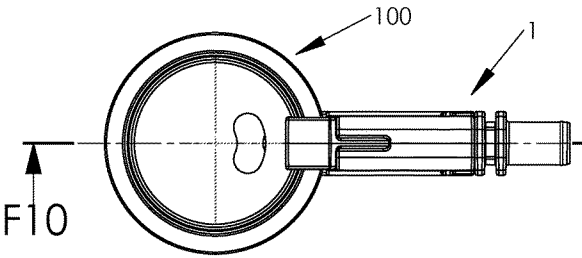
FIG. 9 is a top view of a drain spout attached to a beverage can in accordance with the present invention.
Figure 11:
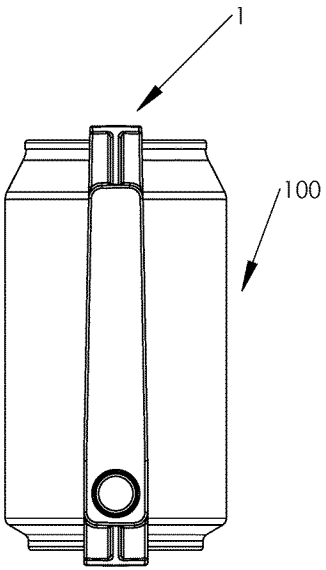
FIG. 11 is a front view of a drain spout attached to a beverage can in accordance with the present invention.
Figure 10:
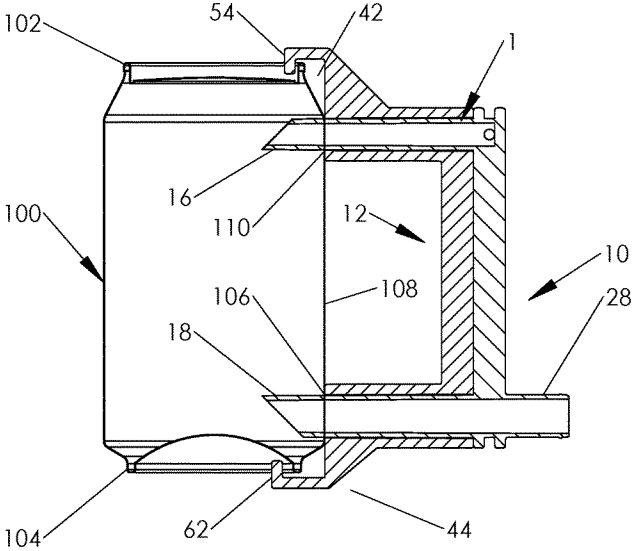
FIG. 10 is a cross sectional side view of a drain spout attached to a beverage can and a puncture member pushed through a side wall of the beverage can in accordance with the present invention.

With reference now to the drawings, and particularly to FIG. 10, there is shown a cross sectional side view of a drain spout 1. With reference to FIGS. 1-6, the drain spout 1 preferably includes a puncture member 10 and a handle member 12. The puncture member 10 includes a retainer base 14, an air puncture tube 16 and a liquid puncture tube 18. A proximal end of the air puncture tube 16 extends from one end and a rear of the retainer base 14. A proximal end of the liquid puncture tube 18 extends from an opposing end and a rear of the retainer base 14. An outer perimeter of the air puncture tube 16 preferably includes a "D" shaped cross section. Where a flat portion 20 of the "D" shaped cross section is on a top of the air puncture tube 16. With reference to FIG. 10, the "D" shaped cross section is critical in preventing liquid from expelling from an air opening 104 formed in a side wall 102 of a beverage can 100. A distal end of the air puncture tube 16 is cut at an angle "A" to create an air cutting tip 22. A longest length of the air puncture tube 16 is located on a bottom thereof. With reference to FIG. 7, an inner perimeter 24 of the air puncture tube 16 does not extend through the retainer base 14. At least one cross hole 26 is formed through a proximal end of the inner perimeter 24 of the air puncture tube 16 to exhaust air.

An outer perimeter of the liquid puncture tube 18 preferably includes a "D" shaped cross section. Where a flat portion 30 of the "D" shaped cross section is on a bottom of the liquid puncture tube 18. With reference to FIG. 10, the "D" shaped cross section is critical in preventing liquid from expelling from a liquid opening 106 formed in the side wall 102 of the beverage can 100. A distal end of the liquid puncture tube 18 is cut at an angle "B" to create a liquid cutting tip 32. A longest length of the liquid puncture tube 18 is located on a top thereof. A liquid drain tube 28 preferably extends from a front of the retainer base 14. The liquid drain tube 28 is substantially concentric with the liquid drain tube 18. The liquid drain tube 28 preferably includes a round cross section. An inner perimeter 34 of the liquid puncture tube 18 extends through the retainer base and the liquid drain tube 28. The air puncture tube 16 and the liquid puncture tube 18 are substantially parallel to each other.

With reference to FIGS. 4-8, the handle member 12 includes a clip base 36, a top support extension 38, a bottom support extension 40, a top clip 42 and a bottom clip 44. A proximal end of the top support extension 38 extends from one end and a rear of the clip base 36. An air through opening 46 is formed through the top support extension 38 and the clip base 36 to slidably receive the air puncture tube 16. A proximal end of the bottom support extension 40 extends from an opposing end and the rear of the clip base 36. A liquid through opening 48 is formed through the bottom support extension 40 and the clip base 36 to slidably receive the liquid puncture tube 18. The top clip 42 extends upward from a top and distal end of the top support extension 38. The top clip 42 preferably includes a top support leg 50, a top extension leg 52, a top end lip 54 and a top gusset 56. The top support leg 50 extends upward from a top surface of the distal end of the top support extension 38. The top extension leg 52 extends outward from an end of the top support leg 50. The top end lip 54 extends downward from an end of the top extension leg 52. The top gusset 56 is formed between the top support extension 38 and the top support leg 50.

The bottom clip 44 extends downward from a bottom and distal end of the bottom support extension 40. The bottom clip 44 preferably includes a bottom support leg 58, a bottom extension leg 60, a bottom end lip 62 and a bottom gusset 64. The bottom support leg 58 extends downward from a bottom surface of the distal end of the bottom support extension 40. The bottom extension leg 60 extends outward from an end of the bottom support leg 58. The bottom end lip 62 extends upward from an end of the bottom extension leg 60. The bottom gusset 64 is formed between the bottom support extension 40 and the bottom support leg 58.

In use, the top end lip 54 of the top clip 42 is inserted into an inner perimeter of a top rim 102 of the beverage can 100 and the bottom end lip 62 of the bottom clip 44 is snapped into a bottom rim 104 of the beverage can 100. The air puncture tube 16 and liquid puncture tube 18 of the puncture member 10 are inserted into the air and liquid openings 46, 48 of the handle member 12. The liquid drain tube 28 is positioned for flow of liquid from the beverage can 100. The clip base 36 is squeezed toward the retainer base 14 with one hand, which results in the liquid puncture opening 106 in a bottom of a sidewall 108 of the beverage can 100 and the air puncture opening 110 in a top of the sidewall 108. The contents of the beverage can 100 will flow out through the liquid drain tube 28.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A spout for draining liquid from a container comprising:

a puncture member includes a retainer base, an air puncture tube and a liquid puncture tube said air puncture tube extends from one end and one side of said retainer base, said liquid puncture tube extends from an opposing end and said one side of said retainer base; and a handle member includes a clip base, a top support extension, a bottom support extension, a top clip and a bottom clip, said top support extension extends from one end of said clip base, said bottom support extension extends from an opposing end of said clip base, said top clip is retained on an end of said top support extension, said bottom clip is retained on an end of said bottom support extension, an air opening is formed through said top support extension and said clip base to receive said air puncture tube, a liquid opening is formed through said bottom support extension and said clip base to receive said liquid puncture tube.

2. The spout for draining liquid from a container of claim 1, further comprising:

a drain spout extends from an opposing side of said retainer base, said drain spout is substantially concentric with said liquid puncture tube.

3. The spout for draining liquid from a container of claim 1 wherein:

an air inner perimeter of said air puncture tube does not extend through said retainer base, a cross hole is formed through said retained base to communicate with said air inner perimeter.

4. The spout for draining liquid from a container of claim 1 wherein:

said top clip includes a top support leg, a top extension leg and a top end lip, said top support leg extends upward from said top support extension, said top extension leg extends outward from said top support leg, said top end lip extends downward from said top extension leg.

5. The spout for draining liquid from a container of claim 1 wherein:

said bottom clip includes a bottom support leg, a bottom extension leg and a bottom end lip, said bottom support leg extends downward from said bottom support extension, said bottom extension leg extends outward from said bottom support leg, said bottom end lip extends upward from said bottom extension leg.

6. A spout for draining liquid from a container comprising:

a puncture member includes a retainer base, an air puncture tube and a liquid puncture tube, said air puncture tube extends from one end and one side of said retainer base, said liquid puncture tube extends from an opposing end and said one side of said retainer base, an end of said air puncture tube is cut at an angle to create an air cutting tip, an end of said liquid puncture tube is cut at an angle to create a liquid cutting tip; and a handle member includes a clip base, a top support extension, a bottom support extension, a top clip and a bottom clip, said top support extension extends from one end of said clip base, said bottom support extension extends from an opposing end of said clip base, said top clip is retained on an end of said top support extension, said bottom clip is retained on an end of said bottom support extension, an air opening is formed through said top support extension and said clip base to receive said air puncture tube, a liquid opening is formed through said bottom support extension and said clip base to receive said liquid puncture tube.

7. The spout for draining liquid from a container of claim 6, further comprising:

a drain spout extends from an opposing side of said retainer base, said drain spout is substantially concentric with said liquid puncture tube.

8. The spout for draining liquid from a container of claim 6 wherein:

an air inner perimeter of said air puncture tube does not extend through said retainer base, a cross hole is formed through said retained base to communicate with said air inner perimeter.

9. The spout for draining liquid from a container of claim 6 wherein:

said top clip includes a top support leg, a top extension leg and a top end lip, said top support leg extends upward from said top support extension, said top extension leg extends outward from said top support leg, said top end lip extends downward from said top extension leg.

10. The spout for draining liquid from a container of claim 6 wherein:

said bottom clip includes a bottom support leg, a bottom extension leg and a bottom end lip, said bottom support leg extends downward from said bottom support extension, said bottom extension leg extends outward from said bottom support leg, said bottom end lip extends upward from said bottom extension leg.

11. The spout for draining liquid from a container of claim 6 wherein:

a longest length of said air puncture tube is located on a bottom thereof; and a longest length of said liquid puncture tube is located on a top thereof.

12. A spout for draining liquid from a container comprising:

a puncture member includes a retainer base, an air puncture tube and a liquid puncture tube, said air puncture tube extends from one end and one side of said retainer base, said liquid puncture tube extends from an opposing end and said one side of said retainer base, said air and liquid puncture tubes include "D" shaped cross sections; and a handle member includes a clip base, a top support extension, a bottom support extension, a top clip and a bottom clip, said top support extension extends from one end of said clip base, said bottom support extension extends from an opposing end of said clip base, said top clip is retained on an end of said top support extension, said bottom clip is retained on an end of said bottom support extension, an air opening is formed through said top support extension and said clip base to receive said air puncture tube, a liquid opening is formed through said bottom support extension and said clip base to receive said liquid puncture tube.

13. The spout for draining liquid from a container of claim 12, further comprising:

a drain spout extends from an opposing side of said retainer base, said drain spout is substantially concentric with said liquid puncture tube.

14. The spout for draining liquid from a container of claim 12 wherein:

an air inner perimeter of said air puncture tube does not extend through said retainer base, a cross hole is formed through said retained base to communicate with said air inner perimeter.

15. The spout for draining liquid from a container of claim 12 wherein:

said top clip includes a top support leg, a top extension leg and a top end lip, said top support leg extends upward from said top support extension, said top extension leg extends outward from said top support leg, said top end lip extends downward from said top extension leg.

16. The spout for draining liquid from a container of claim 12 wherein:

said bottom clip includes a bottom support leg, a bottom extension leg and a bottom end lip, said bottom support leg extends downward from said bottom support extension, said bottom extension leg extends outward from said bottom support leg, said bottom end lip extends upward from said bottom extension leg.

* * * * *